United States Patent [19]

Dvorak

[11] 3,980,162

[45] Sept. 14, 1976

[54] FLAME AND HEAT-RESISTANT LUGGAGE CASE

[76] Inventor: Sidney T. Dvorak, 9428 Stenton Ave., Philadelphia, Pa. 19118

[22] Filed: Sept. 4, 1975

[21] Appl. No.: 610,129

[52] U.S. Cl. ..... 190/41 R; 150/1.6

[51] Int. Cl.[2] ..... A45C 3/02

[58] Field of Search ..... 190/41 R, 40, 23; 150/1.6; 224/47

[56] References Cited

UNITED STATES PATENTS 3,339,781 9/1967 Schurman ..... 190/41 R 3,544,418 12/1970 Holtzman ..... 190/41 R

FOREIGN PATENTS OR APPLICATIONS 511,377 5/1952 Belgium ..... 190/41 R

*Primary Examiner*—Herbert F. Ross

*Attorney, Agent, or Firm*—Arthur A. Jacobs

[57] ABSTRACT

Flame and heat-resistant luggage case constructed of flame-resistant laminated materials and having a surrounding air space, when in closed position, to act as a heat-insulating means.

5 Claims, 4 Drawing Figures

FLAME AND HEAT-RESISTANT LUGGAGE CASE

This invention relates to luggage cases and the like, and it particularly relates to flame and heat-resistant luggage cases and the like, and, preferably, cases which are impact-resistant.

Luggage cases are often constructed to be substantially waterproof or crushproof under relatively light pressure. However, few, if any, luggage cases have heretofore been made which are highly flame and heat-resistant and which may also be resistant to high compressive forces as well as to moisture.

The concept of providing high flame and heat resistance, although important for all luggage, is especially important for brief cases or attache cases which may sometimes contain highly important and irreplaceable documents. Such documents should, if possible, be kept safe in all types of fires where the heat and flames may be intense. It is also desirable that, if possible, they be kept safe when subjected to explosive or crash-induced compressive forces such as would be encountered in airplane crashes, automobile accidents, or the like.

It is, therefore, one object of the present invention to provide a luggage case which is capable of affording a high degree of flame and heat resistance.

Another object of the present invention is to provide a luggage case of the aforesaid type which is also capable of withstanding intense pressure.

Another object of the present invention is to provide a luggage case of the aforesaid type which is relatively easy and inexpensive to produce.

Other objects and many of the attendant advantages of this invention will be readily appreciated as the same becomes better understood by reference to the following description when read in conjunction with the accompanying drawings wherein.

Figure 1:
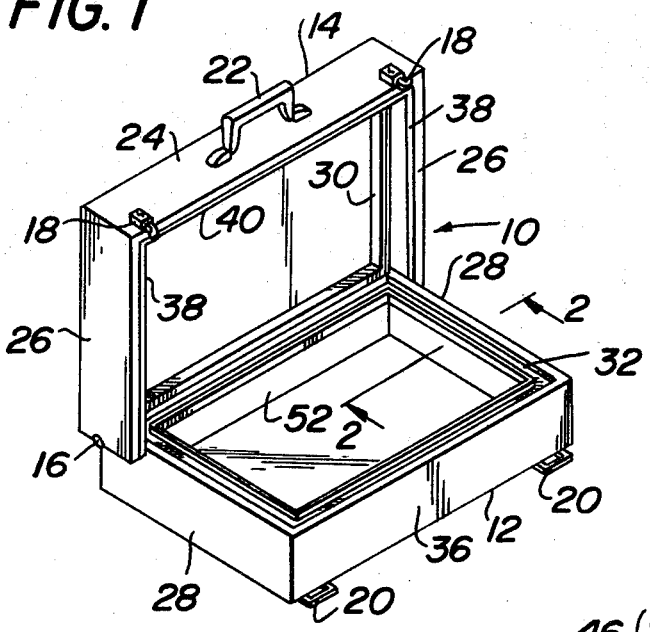
FIG. 1 is a perspective view showing an open attache case embodying the present invention.

Referring in greater detail to the figures of the drawings wherein similar reference characters refer to similar parts, there is shown in FIG. 1 an attache case, generally designated 10, comprising a lower or body section 12 and an upper or cover section 14, said sections being hinged at 16. A locking means is provided for holding the sections together, this locking means comprising hooks 18 releasably engageable in eyelets 20. Any other suitable locking means may be substituted for those shown, the particular locking means, per se, forming no part of the present invention. A carrying handle 22 is provided on the front wall 24 of the cover section 14.

The cover section 14 is provided with side walls 26 which, when the sections are in closed position, overlap the side walls 28 of the body section 12. Inwardly spaced from the side walls 26 of the cover section 14, as well as from the front and rear walls thereof, is a rectangular flange 30. This flange 30 is adapted to engage within a corresponding rectangular groove 32 positioned inwardly of the front, rear and side walls.

Figure 2:
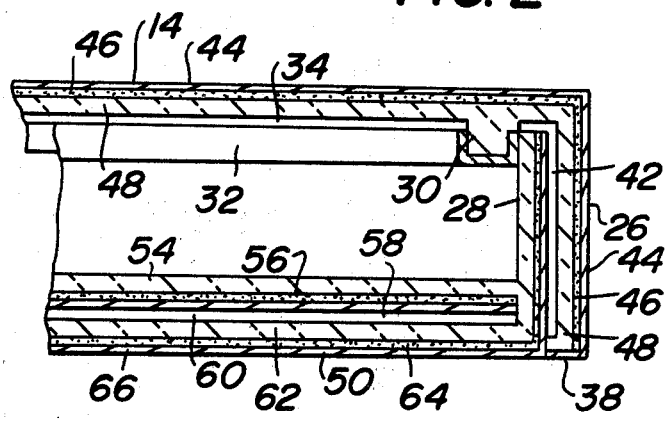
FIG. 2 is a fragmentary sectional view taken on line 2—2 of FIG. 1, but with the case in closed position.

The flange 30 is somewhat longer than the groove 32 is deep, whereby an air space 34 is provided between the cover section 14 and the body section 12 when the case is closed (note FIG. 2). The front wall 24 of the cover section 14 is also spaced from the front wall 36 of the body section 12 and the side walls 26 of the cover section 14 are similarly spaced from the side walls 28 of the body section 12 when the case is in closed position (note FIG. 2)

The side walls 26 of the cover section 14 are provided with inwardly extending flanges 38 which abut against the lower portion of the side walls 28, while the front wall 24 of the cover section 14 has an inwardly extending flange 40 which abuts against the lower portion of the front wall 36, these flanges, thereby, not only acting to maintain the air space, such as shown at 42 in FIG. 2, but also acting as an abutment-type closure between the walls of the cover and body sections.

The construction of each section of the case is preferably in the form of a laminate. The upper section 14, as shown in FIG. 2, is formed of three layers, the top layer 44 being sheet aluminum, the middle layer 46 being a flame-retardant latex polymer, and the bottom layer 48 being fiberglass. Both the aluminum and the fiberglass are non-burning materials, while the latex polymer is preferably a vinyl chloride-vinylidene chloride copolymer wherein the proportion of vinylidene chloride to vinyl chloride is about 3:1 by weight. Such a latex is commercially available as "Geon 652" (B.F. Goodrich Chem. Co.). This latex is a highly flame retardant material, being difficult to ignite, slow to burn while in contact with a flame source and self-extinguishing, i.e. it stops burning immediately when the flame source is removed. This latex also adheres strongly to both the aluminum and fiberglass, thereby providing a good bonding agent for the laminate.

The bottom wall 50 and the rear wall 52 of the lower section 12 are of the same construction, comprising a double laminate of the same materials used in the construction of the cover section 14, but with an air space between each laminated portion. In this respect, the inner layer 54 (as shown in FIG. 2) is fiberglass, the next layer 56 is the vinyl chloride-vinylidene chloride copolymer, and the next layer 58 is aluminum, below which is an air space 60. The air space 60 is followed by layer 62 of fiberglass, layer 64 of latex copolymer and layer 66 of aluminum.

The side and front walls 28 and 36, respectively, of the body section 12 are formed of a single laminate construction identical to that of the cover section 14.

The single laminate construction is used at the sides and front because the overlapping walls of the cover section provide a double laminate arrangement. The only part of the case that, when closed, comprises a single laminate construction is the top. However, the flange 30 here acts as a reinforcing means. Nevertheless, if so desired, in order to obtain maximum impact, flame and heat resistance, the top wall may also be constructed of a double laminate construction in the same manner as the bottom wall 50 and rear wall 52.

The case described above is not only extremely fire-resistant but is also highly heat-resistant due to both the laminate construction and the air space which acts as a heat-insulating means. The flange 30, furthermore, not only acts as a reinforcing means but also acts as a spacing means to provide the air space, and, in addition, serves as a barrier against the entrance of moisture into the interior of the case and as an interlocking means between the two sections.

Figure 3:
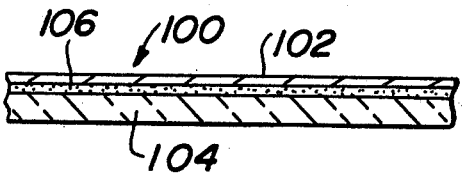
FIG. 3 is a fragmentary sectional view, showing a more completely crushproof modification of a case such as shown in FIGS. 1 and 2.

FIG. 3 represents a portion of the cover section of a case identical to that shown in FIGS. 1 and 2 but this case, generally designated 100, substitutes stainless steel in the upper layer 102 and asbestos in the lower layer 104. The intermediate layer 106 is the same latex copolymer described above. This form of the invention serves the same purpose as that described above but is more resistant to compressive forces because of the substitution of steel for aluminum.

Figure 4:
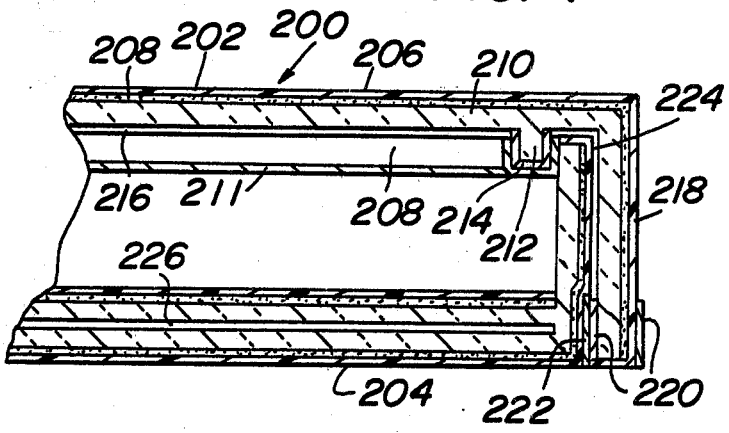
FIG. 4 is a sectional view, similar to FIG. 2, but showing a more flexible, but less crushproof modification thereof.

FIG. 4 illustrates a lighter and more flexible form of the invention wherein the case, generally designated 200, comprises the same cover section 202 and body section 204, as in the case described above, these sections being hinged together in the same manner. In this case, however, the laminated cover section 202 is formed by an upper layer 206 of nylon, an intermediate layer 208 of the latex copolymer described above, and a bottom layer 210 of asbestos. The nylon is not entirely flame-proof but it does burn and melt slowly, forming droplets which may fall away and prevent flame propogation.

Since the materials used in this construction are generally flexible, the rectangular groove, indicated at 208, is lined with a rigid metal such as steel or the like, as at 211, and the rectangular flange 212 is similarly reinforced, as at 214, so that the flange and groove can coact to form the air space 216 and to serve the other purposes described above. In similar manner, the lower portion of the front and side walls of the cover section, indicated at 218, are reinforced by metal plates 220, while the lower portion of the corresponding walls of the body section are similarly reinforced at 222. The inner metal plate 220 also serves as a spacing member to form the air space 224.

The bottom and rear walls of the body section 204 are made of the same materials as the cover section but are double laminates separated by an air space 226, while the side and front walls are of the same construction as the cover section 202.

The materials forming the above-described structures are those which are herein preferred; however, other somewhat equivalent materials may be substituted within the scope of the invention.

The invention claimed is:

1. A flame and heat-resistant luggage case comprising a hollow body section and a hollow cover section, said body section having front, rear, bottom and side walls and having an open top, said cover section having front, rear, top and side walls and having an open bottom, said cover section being hinged to said body section at the corresponding rear walls of said sections, the front and side walls of said cover section completely overlapping the front and side walls of said body section and the top wall of said cover section extending beyond the front and side walls of said body section when said cover section is in hingedly closed position against said body section thereby providing a uniform space between respective front walls and respective side walls of the cover and body sections, said space being closed at the outer edges of the front and side walls of the cover by peripheral inwardly extending flanges which abut against the front and side walls respectively of the body when in closed position, and spacing means holding the top wall of said cover section spaced from the free edges of the front and side walls of said body section when said cover is in closed position, said rear wall and bottom wall of said body section comprises at least two layers separated from each other by an air space substantially throughout the lengths of said layers.

2. The luggage case of claim 1 wherein each wall of said body and cover sections comprises a plurality of layers laminated to each other by a flame-resistant bonding layer.

3. The luggage case of claim 1 wherein said body section is provided with a peripheral groove inwardly of the front, rear and side walls thereof, and said cover section is provided with a peripheral flange spaced inwardly of the front, rear and side walls thereof, said flange being of greater height than the depth of said groove, said flange being engageable within said groove when said sections are in said closed position to form said spacing means holding the top wall of said cover section spaced from the open top of said body section.

4. The luggage case of claim 1 wherein said body and cover sections are substantially rigid.

5. The luggage case of claim 1 wherein said body sections are substantially flexible but said groove and said flange are rigid.

* * * * *

UNITED STATES PATENT OFFICE

CERTIFICATE OF CORRECTION

PATENT NO. : 3,980,162

DATED : September 14, 1976

INVENTOR(S) : Sidney T. Dvorak

It is certified that error appears in the above-identified patent and that said Letters Patent are hereby corrected as shown below:

Change the address of the patentee, Sidney T. Dvorak, to 9425 Stenton Avenue, Philadelphia, Pennsylvania 19118.

Signed and Sealed this

Twenty-third Day of November 1976

[SEAL]

*Attest:*

RUTH C. MASON
*Attesting Officer*

C. MARSHALL DANN
*Commissioner of Patents and Trademarks*